US005619916A

United States Patent [19]

Sekine

[11] Patent Number: 5,619,916

[45] Date of Patent: Apr. 15, 1997

[54] PRINTER WITH A MECHANISM FOR IDLING SETTING WHEELS

[75] Inventor: Kiyoyuki Sekine, Ageo, Japan

[73] Assignee: Shinsei Industries Co., Ltd., Japan

[21] Appl. No.: 256,116

[22] PCT Filed: Nov. 17, 1993

[86] PCT No.: PCT/JP93/01681

§ 371 Date: Jun. 23, 1994

§ 102(e) Date: Jun. 23, 1994

[87] PCT Pub. No.: WO94/12350

PCT Pub. Date: Jun. 9, 1994

[30] Foreign Application Priority Data

Nov. 20, 1992 [JP] Japan ..... 4-352262

[51] Int. Cl.[6] ..... B41J 1/60

[52] U.S. Cl. ..... 101/111; 101/109

[58] Field of Search ..... 101/111, 109, 101/327, 333, 334, 110, 106, 105, 103

[56] References Cited

U.S. PATENT DOCUMENTS

| | | | |
|---|---|---|---|
| 2,598,806 | 6/1952 | Lauer | 101/103 |
| 4,163,422 | 8/1979 | Hamiseh | 101/105 |
| 4,679,500 | 7/1987 | Volk | 101/111 |
| 4,843,960 | 7/1989 | Ernst et al. | 101/105 |
| 4,951,565 | 8/1990 | Volk | 101/111 |

FOREIGN PATENT DOCUMENTS

| | | | |
|---|---|---|---|
| 3738186 | 5/1989 | Germany | 101/105 |
| 56-232 | 1/1981 | Japan . | |
| 59-6237 | 2/1984 | Japan . | |

*Primary Examiner*—Edgar S. Burr
*Assistant Examiner*—Anthony H. Nguyen
*Attorney, Agent, or Firm*—Graham & James LLP

[57] ABSTRACT

A printer comprising printing type belts 16 and 16' having printing types **16*b* and 16*b*' as well as indicating types 16*d* and 16*d*', and setting wheels 7 and 7' for turning the printing type belts, and configured to limit the turnings of the printing type belts for preventing the indicating types from being fouled, and to allow the setting wheels to rotate idly for preventing breakage of the printer itself after the printing type belts have reached rotation-limited positions. The rotation-limited position is determined by a pair of convexities 16*e* and 16*f* or 16*e*' and 16f' formed on each of the printing type belts and edges 4*a* and 5*a* or 4*a*' and 5*a*' of display window frames 4 and 5 or 4' and 5'. The setting wheels are allowed to rotate idly by recesses which are formed in the printing type belts so as to be engaged with teeth 7*b* and 7*b*' of the setting wheels, and configured so as to have slanted surfaces 16*h* and 16*h*'** rising from sides near the convexities toward sides far from the convexities.

8 Claims, 2 Drawing Sheets

PRINTER WITH A MECHANISM FOR IDLING SETTING WHEELS

TECHNICAL FIELD

The present invention relates to a printer, and more specifically to a printer which is to be applied to hand labellers or the like and which comprises: a display window; a plurality of setting wheels rotatably mounted about a common axis; endless printing type belts which carry in a region of their length at the outer surface printing types, in another region of their length at the outer surface indicating types which are stretched around the setting wheels and around a printing type receiver arranged with a space kept from the setting wheels and which are adjustable by turning the setting wheels; setting wheels having an actuating knob; and stop means for limiting the turning angle of the printing type belts when the printing belts have reached adjustable limit positions thereof.

BACKGROUND ART

Such a printer is described in U.S. Pat. No. 4,679,500. When using the printer, the printing types which are disposed at a predetermined printing position are inked and then brought into contact with the medium to be printed. The display or indicating types are associated in their position with the printing types on the belts in such a manner that for each printing type which happens to be disposed in the printing position a corresponding indicating type is disposed in a display position and is visible to the operator so that the operator can see which character, symbol or numeral can be printed with the printing type at that instant in the printing position. For reasons of good legibility the indicating types are generally disposed on a white background. If the setting wheels could be turned with the aid of the setting shaft to any desired extent it could easily happen that the indicating types mistakenly reach the printing position and are inked with printing ink. It would also be possible for printing ink to get onto the background of the indicating types so that the characters, symbols and numerals would then not easily be legible through the display window.

In order to solve this problem, the printer disclosed by the above-mentioned U.S. Pat. No. 4,679,500 uses a stop shoulder which is formed on printing type receivers and to be engaged with a front tooth disposed in adjusting directions of the printing belt as well as a web which is disposed at a location spaced from the stop shoulder for a distance which is smaller than the height of at least the tooth lying in front of each adjustment direction of the printing belt plus the printing belt thickness so that the front tooth is stopped between the stop shoulder and the web so as to stop the printing belt at a predetermined position even when a high torque is transmitted from the actuating knob. The actuating knob is coupled with the setting shaft under frictional forces only and slips on the setting shaft after the printing belt has reached the predetermined position at which the front tooth is brought into contact with the stop shoulder.

When the printing belt has reached the limit position at which it is not adjustable with the aid of the actuating knob by way of the setting wheel, the operator feels a load which is heavier than that felt within the adjustable region, whereby the operator recognizes that the printing belt has reached the limit position. When a desired indicating type happens to pass over the display window in practical use of such a printer, the operator often tries to set the desired indicating type in the display window by turning the actuating knob in the same direction. Such an operation brings about a result that the front tooth passes forcibly through between the stop shoulder and the web, thereby breaking the printing type belt and the web or making the printer itself unusable. Though the actuating knob slips on the setting shaft after the printing belt has reached the limit position at which the printing type belt is not adjustable for preventing the trouble described above, repetition of such a forcible operation results in breakage of the actuating knob or detachment thereof from the setting shaft, thereby making the printer incapable of performing the original function thereof. The conventional printer described above has another defect that it requires a high manufacturing cost since the printer requires special parts such as the web and the web must be set at a precise distance as measured from each of the stop shoulders.

In view of the defects of the conventional printer described above, it is a primary object of the present invention to provide a printer which is structured so that the setting wheel rotates idly when the actuating knob is turned in a direction to advance the printing type belt after it has reached the limit position at which it is not adjustable any longer with the aid of the actuating knob by way of the setting wheel.

Another object of the present invention is to provide a printer which requires no special parts such as the web for stopping the printing belt at a predetermined position, has a simple configuration and can be manufactured as a low cost.

DISCLOSURE OF INVENTION

In the printer according to the present invention, convexities which are engageable with stop means are formed on printing type belts at locations corresponding to ranges within which the printing belts are adjustable by turning setting wheels and a plurality of recesses are formed on the printing belts so as to be engageable with teeth of the setting wheels, of the recesses being slanted so as to rise from sides near the convexities to other sides far from the convexities. When the setting wheels are rotated in the same direction after the convexities are engaged with the stop means during adjustment of the printing type belts by turning the setting wheels, the recesses and the convexities serve so that the teeth of the setting wheels move along the slanted surfaces of the recesses and travel while forcibly pushing the printing type belts outward in the radial directions of the setting wheels intermittently. Accordingly, only the setting wheels are rotated with the printing type belts kept stopped, thereby preventing the printer from being broken. Since a high torque is necessary for rotating the setting wheels while the printing type belts are pushed outward intermittently as described above, the operator can recognize by way of the actuating knob a condition where the printing type belts have reached limits of ranges within which the printing type belts are adjustable.

Further, the stop means which are to be engaged with the convexities of the printing type belts are formed as portions of members composing a display window. Accordingly, the printer according to the present invention requires no special parts for forming the stop means and can have a simple configuration, thereby being manufacturable at a low cost.

BEST MODE FOR CARRYING OUT THE INVENTION

Figure 1:
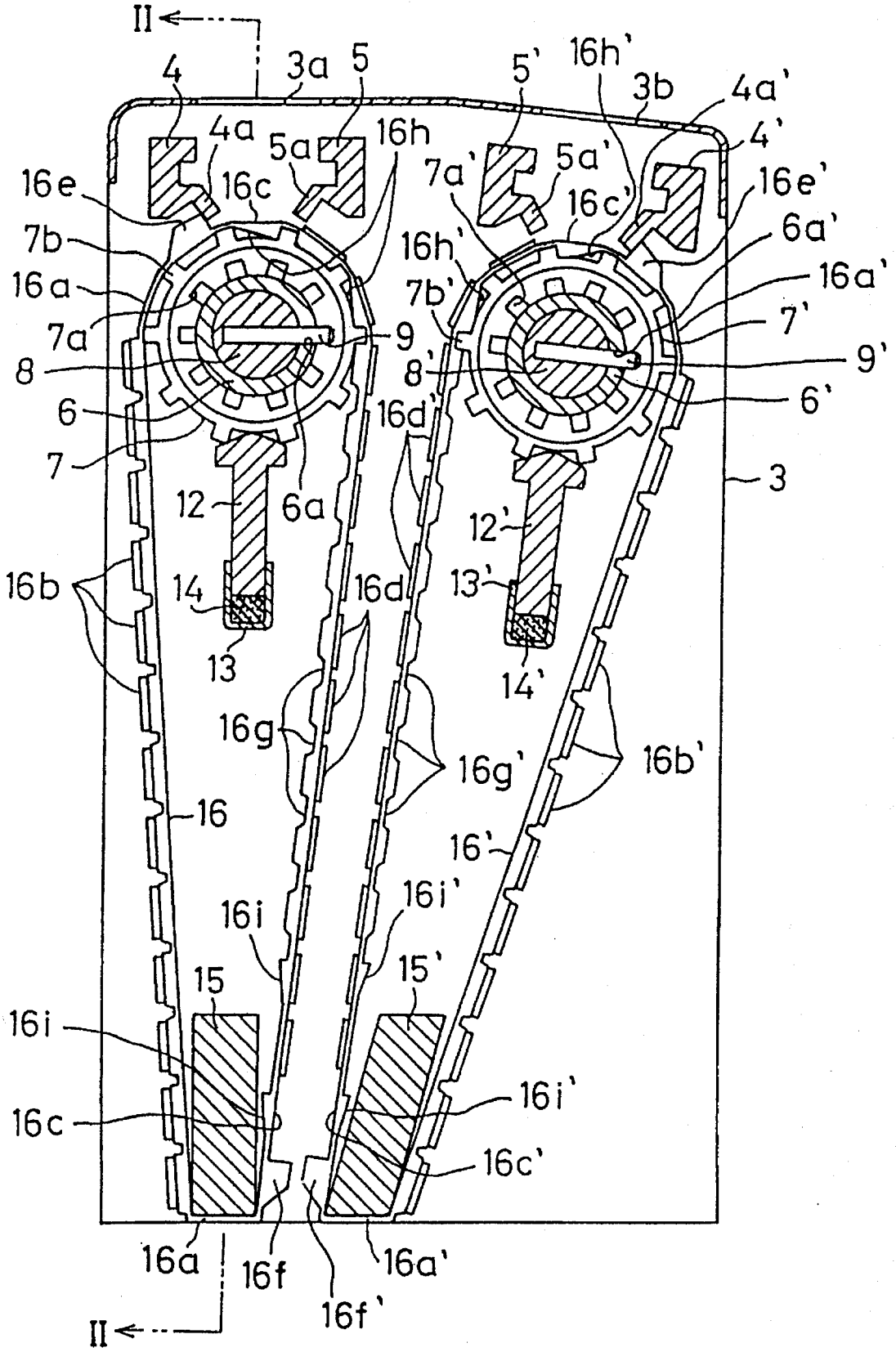
FIG. 1 is a partial sectional side view illustrating an embodiment of the printer according to the present invention.

Now, the printer according to the present invention will be described more detailedly below with reference to the preferred embodiment thereof illustrated in the accompanying drawings. Shown in FIG. 1 are two printing type belts having configurations and functions which are substantially the same as each other. Therefore, description will be made only the printing type belt which is shown on the left side, whereas the printing type belt shown on the right side will not be explained in particular while indicating parts thereof by using the same reference numerals, but with primes, as those for the parts of the printing type belt shown on the left side.

Figure 2:
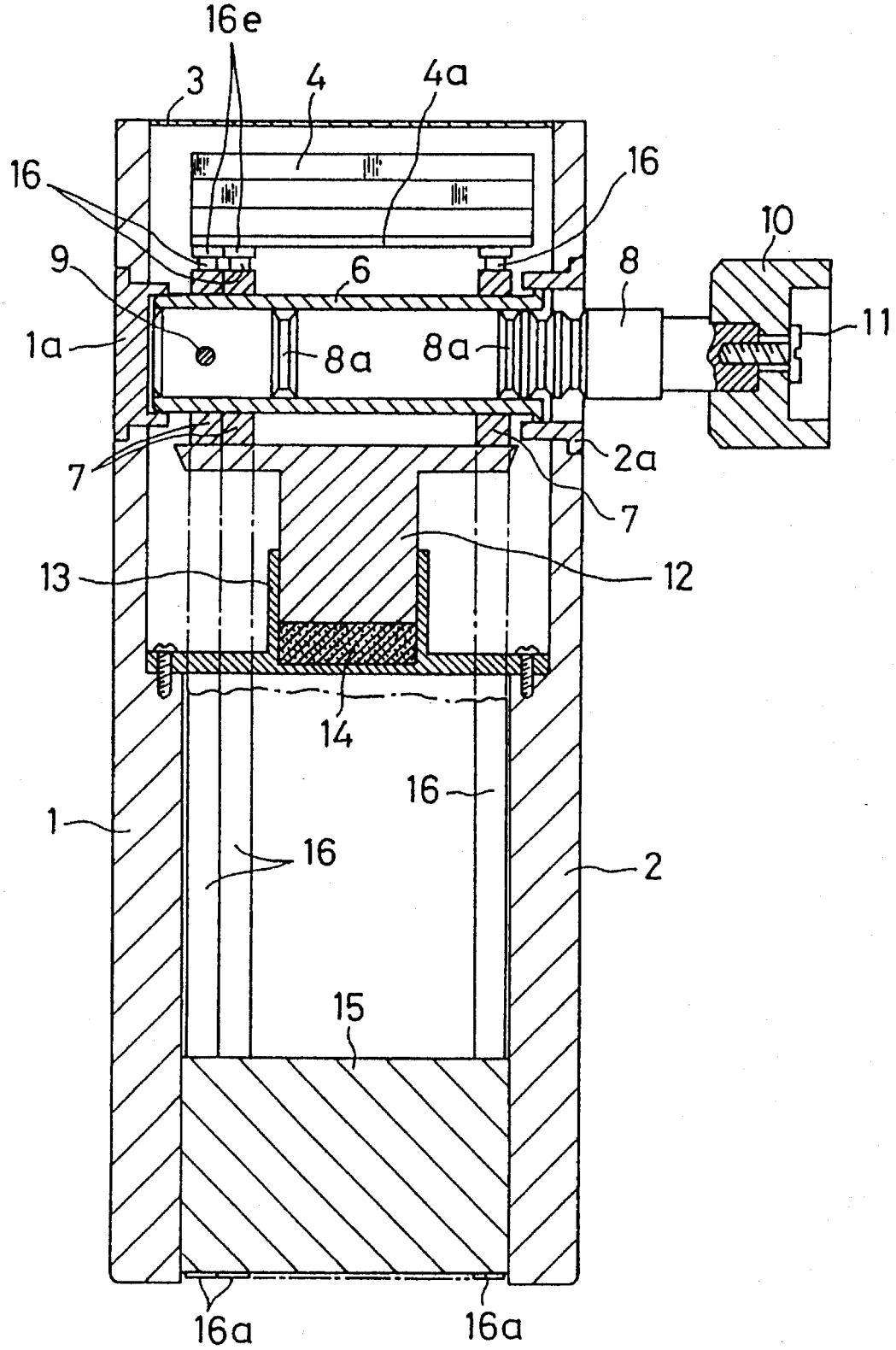
FIG. 2 is a sectional view taken along II—II line in FIG. 1.

In FIG. 1 and FIG. 2, the reference numerals 1 and 2 represent side plates for housing the printer, and the reference numeral 3 designates a cover plate which has openings 3*a* and 3*b* disposed so as to match with a display window to be described later, and is attached to the side plates 1 and 2. The reference numerals 4 and 5 denote display window frames having edges 4*a* and 5*a* which are formed integrally with the display window frames and serve as stop means, the reference numeral 6 represents a sleeve which is rotatably disposed between the side plates 1 and 2, and has a slit 6*a* formed therein in a longitudinal direction, the reference numeral 7 designates a setting wheel which is mounted integrally with the sleeve 6 or rotatably mounted thereon and has grooves 7*a* formed in an inner surface so as to extend in the radial direction as well as teeth 7*b* formed on an outer surface so as to protrude in the radial direction, the reference numeral 8 denotes a setting shaft which is slidably fitted into the sleeve 6, studded with a pin 9 passing through the slit 6*a* so as to be fitted into the grooves 7*a* and has an end protruding outside the side plate 2, the reference numeral 10 represents an actuating knob which is fixed to the protruding end of the setting shaft 8 with a screw 11 or the like means, the reference numeral 12 designates a click member which has a bottom portion fitted into a box-shaped receiver 13 disposed between the side plates 1 and 2 so as to be vertically shiftable as well as a top portion to be inserted between the teeth of the setting wheel 7 for preventing this wheel from rotating unnecessarily, the reference numeral 14 designates an elastic member which is interposed between the lower surface of the click member 12 and the bottom surface of the receiver 13 for elastically urging the click member 12 upward, and the reference numeral 15 represents a printing type receiver which is disposed between the side plates 1 and 2, and has a width sufficient for mounting one of the printing types arranged on the printing type belt to be described later. The reference numeral 16 designates a printing type belt which is stretched around the setting wheel 7 and the printing type receiver 15, and has printing types 16*b* arranged on a region corresponding to a half of a longitudinal outer circumferential surface having two portions 16*a* free from printing types at both ends thereof, indicating types 16*d* arranged on another region corresponding to another half of the longitudinal outer circumferential surface having two portions 16*c* free from indicating types at both ends thereof, and convexities 16*e* and 16*f* formed on a region of the outer circumferential surface located between the portion 16*a* free from the printing types and the portion 16*c* free from the indicating types so as to be brought into contact with the edge 4*a* of the display window frame 4 and the edge 5*a* of the display window frame 5. Recesses 16*g* which are to be engaged with the teeth 7*b* of the setting wheel 7 are formed in the longitudinal inner circumferential surface corresponding to the region of the indicating types. In particular, two recesses which are adjacent to the convexities 16*e* and 16*f* are formed as slanted surfaces 16*h* and 16*i* which rise from the sides near the convexities 16*e* and 16*f* toward the sides far from these convexities.

As is seen from FIG. 2, disposed on the sleeve 6 are a required number of setting wheels 7 so as to be adjacent to one another in the configuration described with reference to FIG. 1 and the printing type belt 16 having the configuration described with reference to FIG. 1 is stretched around each of the setting wheels and the printing type receiver 15. The slit 6*a* formed in sleeve 6 extends almost throughout the entire range of the longitudinal direction thereof except both the ends thereof, whereby the pin 9 can be fitted into any one of the grooves 7*a* formed in the setting wheels 7 by pulling the setting shaft 8 rightward with the aid of the actuating knob in FIG. 2. In other words, the grooves 7*a* formed in all the setting wheels 7 are aligned in the longitudinal direction of the sleeve 6 owing to the function of the click member 12. In addition, the sleeve 6 is rotatably supported by holding frames 1*a* and 2*a* fitted into the side plates 1 and 2. Each of the holding frames is equipped with an auxiliary device which composes a click mechanism between the setting shaft 8 and the holding frame. This auxiliary device consists of a cylindrical member which extends in the radial direction and has a closed end, a ball capable of being fitted into a plurality of circular grooves 8*a* formed in the setting shaft 8, and a spring which is accommodated in the cylindrical member and urges the ball toward the circular grooves.

Now, description will be made of functions of the printer according to the present invention.

FIG. 1 illustrates a condition where the printing type belt 16 has reached the limit position thereof. In this condition, the convexity 16*e* is engaged with the edge 4*a* of the display window frame 4, the portion 16*a* free from the printing types is mounted on the printing type receiver 15 and the portion 16*c* free from the indicating types is visible in the display window. When the setting wheel 7 is rotated clockwise with the aid of the actuating knob 10, one of the teeth 7*b* which is located on the lowest position of the slanted surface 16*h* forming the recess moves toward the highest position and each tooth 7*b* passes while pushing upward the printing type belt 16 which has a low plasticity in the radial direction of the setting wheel 7. Accordingly, the setting wheel 7 rotates idly while the printing type belt 16 is kept stopped. Since a tooth which is regularly engaged with the recess 16*g* slightly urges the printing type belt 16 clockwise at an initial stage of the clockwise rotation of the setting wheel, tension of a region of the printing type belt which ranges from the pushed point to the convexity 16*e* is slightly lowered, thereby facilitating to push upward the printing type belt.

When the setting wheel 7 is rotated counterclockwise with the aid of the actuating knob 10 in the condition illustrated in FIG. 1, on the other hand, the tooth 7*b* is engaged with a stepped surface which is formed between the highest point and the lowest point of the slanted surface forming the convexity, whereby the printing type belt 16 is actuated counterclockwise along with the rotation of the setting wheel 7, a desired character, symbol or numeral of the printing types is mounted on the printing type receiver 15 and the corresponding character, symbol or numeral of the indicating types is visible in the display window. Adjustment of the printing type belt becomes impossible when the convexity 16*f* is engaged with the edge 5*a* of the display window frame 5. When the setting wheel 7 is rotated counterclockwise with the aid of the actuating knob at a subsequent stage, only the setting wheel 7 rotates idly and the printing type belt 16 is kept stopped at the limit position thereof owing to the function described above. As is understood from the foregoing description, the printer according to the present invention cannot be troubled or is free from breakage of the printing type belt or the other member which is caused by rotating the setting wheel after the printing belt has reached the limit position thereof at which it is not adjustable even when the setting wheel 7 is rotated in either of the directions for adjusting the printing type belt 16.

In contrast to the conventional printer which uses the printing type belt having only one portion free from types, the printer according to the present invention adopts the printing type belt having two portions free from types at both the ends thereof. Accordingly, the printer according to the present invention is free, unlike the conventional printer, from the defect that the rear surface of the printing type belt is not brought into close contact with the printing type receiver 15 and the printing type belt is allowed to be inclined.

In the printer according to the present invention which has the configuration described above, one of the printing type belt which is to be adjusted is determined by selecting one of the grooves 7*a* of the setting wheel into which the pin 9 is to be fitted after shifting the setting shaft 8 in the longitudinal direction thereof. Though portions of the display window are utilized as the stop means for the printing type belt 16 in the embodiment of the present invention, it is possible to use independent stoppers in the printer according to the present invention.

INDUSTRIAL APPLICABILITY

As is understood from the foregoing description, the printer according to the present invention is usable as a convenient hand-grip type printer or effectively as a printer for hand labellers such as that disclosed by Japanese Patent Publication No. Sho. 61-35054.

What is claimed is:

1. A printer comprising:

a display window;

a plurality of setting wheels rotatably disposed adjacent to said display window, each of said plurality of setting wheels having teeth formed at equal intervals on respective outer circumferential surfaces thereof;

a printing type receiver opposingly arranged in spaced relation to said setting wheels;

a plurality of endless printing type belts, each printing type belt being stretched around one of said plurality of setting wheels and said printing type receiver, each of said plurality of endless printing type belts including:

a first convexity and a second convexity protruding from separate locations on an outer circumferential surface of said endless printing type belt, said first and second convexities dividing said outer circumferential surface of said endless printing type belt into first and second regions;

a plurality of printing types disposed on an outer circumferential surface in said first region;

a plurality of indicating types disposed on an outer circumferential surface in said second region; and a plurality of recesses, disposed on an inner circumferential surface in said second region, for respectively engaging the teeth of each of said setting wheels, each of said endless printing type belts being rotatable in accordance with a rotation of a corresponding setting wheel;

a setting shaft for selectively engaging at least one of said plurality of setting wheels;

a knob coupled with said setting shaft for maneuvering said setting shaft; and stop means, engageable with said convexities, for preventing said printing type belts from rotating when one of said two convexities meets said stop means in accordance with a rotation of each of said endless printing type belts;

wherein said plurality of recesses disposed in said second region, includes at least one recess located adjacent to a respective longitudinal end of said second region, said at least one recess having a wall formed as a slanted surface rising gradually in a longitudinally inward direction relative to said second region to allow the teeth of one of said setting wheels to slide thereon, thereby causing said one setting wheel to rotate idly in response to a rotating force applied thereto in one direction.

2. A printer according to claim 1, wherein said display window includes a plurality of frame members, said stop means being integrally formed with at least one of said plurality of frame members.

3. A printer according to claim 1 or 2 wherein with respect to the outer circumferential surface of each of said endless printing type belts, portions adjacent to said convexities are level with neither printing types nor indicating types arranged thereon.

4. A printer comprising:

a display window;

at least one setting wheel rotatably disposed adjacent to said display window, said at least one setting wheel having a plurality of teeth formed on an outer surface thereof;

rotating means for rotating said at least one setting wheel;

a printing type receiver disposed opposite said display window;

an endless printing type belt flexibly stretched around said at least one setting wheel and said printing type receiver;

a plurality of printing types arranged along an outer surface of said printing type belt;

a plurality of indicating types arranged along an outer surface of said printing type belt;

a plurality of convexities arranged on said outer surface of said printing type belt;

a plurality of recesses arranged along an inner surface of said printing type belt to engage said plurality of teeth of said at least one setting wheel;

stopping means for stopping a rotation of said printing type belt, said stopping means engaging at least one of said plurality of convexities; and rotation permitting means for permitting free rotation of said setting wheel when said stopping means has stopped said rotation of said printing type belt.

5. The printer as recited in claim 4, wherein said rotating means comprises:

a setting shaft rotatably coupled to said at least one setting wheel; and a knob coupled to said setting shaft.

6. The printer as recited in claim 4, wherein said stopping means comprises an edge of said display window.

7. The printer as recited in claim 4, wherein said rotation permitting means comprises at least one extension arranged on an inner surface of said printing type belt, said at least one extension being formed so as to permit said teeth to pass underneath said at least one extension in only one angular direction.

8. The printer as recited in claim 7, wherein said at least one extension has a gradually inclined surface.

* * * * *